United States Patent [19]

Fraser, Jr. et al.

[11] Patent Number: 5,017,107

[45] Date of Patent: May 21, 1991

[54] SLIDER BLOCK RADIAL COMPLIANCE MECHANISM

[75] Inventors: Howard H. Fraser, Jr., LaFayette, N.Y.; Shahrokh Etemad, Stratford, Conn.

[73] Assignee: Carrier Corporation, Syracuse, N.Y.

[21] Appl. No.: 432,249

[22] Filed: Nov. 6, 1989

[51] Int. Cl.[5] ..... F04C 18/04; F04C 27/00

[52] U.S. Cl. ..... 418/55.5; 418/57; 418/151

[58] Field of Search ..... 418/14, 55 D, 57, 151, 418/55.5

[56] References Cited

U.S. PATENT DOCUMENTS 4,457,675 7/1984 Inagaki et al. ..... 418/55 D
4,580,956 4/1986 Takahashi et al. ..... 418/14
4,764,096 8/1988 Sawai et al. ..... 418/55 D

FOREIGN PATENT DOCUMENTS 59-120794 7/1984 Japan ..... 418/55 D

*Primary Examiner*—John J. Vrablik
*Attorney, Agent, or Firm*—David J. Zobkiw

[57] ABSTRACT

The orientation of the elements of a slider block radial compliance mechanism for a scroll compressor is such that the point of application of the actuating force is shifted from a first line extending through the center of gravity of the counterweight and the axis of the crankshaft to a second line parallel to said first line and extending through the axis of the orbiting scroll. The result of the changed orientation is an increase in the magnitude of both the sealing force between the scroll elements and the actuating force to move the mechanism.

4 Claims, 3 Drawing Sheets

SLIDER BLOCK RADIAL COMPLIANCE MECHANISM

BACKGROUND OF THE INVENTION

In a scroll compressor the trapped volumes are in the shape of lunettes and are defined between the wraps or elements of the fixed and orbiting scrolls and their end plates. The ends of the lunettes define points of tangency or contact between the wraps of the fixed and orbiting scrolls. These points of tangency or contact are transient in that they are continuously moving towards the center of the wraps as the trapped volumes continue to reduce in size until they are exposed to the outlet port. These points of tangency or contact represent points of wear and leakage so it is desirable to permit outward radial movement of the orbiting scroll to maintain sealing contact of its wrap with that of the fixed scroll. Further, because the trapped volume may contain a liquid slug of refrigerant and/or oil it is desirable to permit inward radial movement of the orbiting scroll to permit leakage from the trapped volume(s) to relieve any excessive buildup of pressure. One approach has been to use an eccentric bushing mechanism to provide the connection between the crankshaft and the orbiting scroll. Another approach has been to use a swing link connection between the orbiting scroll and crankshaft. A slider block radial compliance device is briefly mentioned in U.S. Pat. No. 3,924,977. In this patent, the centrifugal force of the orbiting scroll is used to activate the mechanism. The line of movement of the orbiting scroll is along the centrifugal force, i.e. along the line extending from the center of gravity of the counterweight through the center of the crankshaft to the center of the orbiting scroll.

SUMMARY OF THE INVENTION

The present invention is directed to an improved slider block radial compliance mechanism. The orientation of the elements is changed such that a combination of centrifugal and gas forces are used to activate the mechanism and provide a sealing force between the scroll elements. By changing the orientation of the elements according to the teachings of the present invention, the magnitude of both the sealing force between the scroll elements and the actuating force to move the mechanism are increased. This permits an increase in efficiency due to the reduced leakage resulting from the increased sealing force which also permits the wraps to wear in more quickly.

It is an object of this invention to provide an effective radial compliance mechanism.

It is another object of this invention to provide a greater sealing force between the scroll elements.

It is an additional object of this invention to increase the efficiency of a scroll compressor by reducing the leakage.

It is a further object of this invention to increase the activating force of a radial compliance mechanism. These objects, and others as will become apparent hereinafter, are accomplished by the present invention.

Basically, the common axis of the orbiting scroll and the slider block is displaced perpendicularly so as to be located in parallel with the plane containing the axis of the crankshaft and the counterweight center line/center of gravity. As a result, movement of the slider block and the axis of the orbiting scroll is in a plane spaced from and parallel to the plane containing the axis of the crankshaft and the counterweight center line/center of gravity. The angle formed between the line joining the axis of the crankshaft and the counterweight center line/ center of gravity and the extension of the line joining the center of the orbiting scroll and the axis of the crankshaft influences the value of the resultant sealing force and the centrifugal or actuating force. the axis of the crankshaft and the counterweight center line/center of gravity. The angle formed between the line joining the axis of the crankshaft and the counterweight center line/ center of gravity and the extension of the line joining the center of the orbiting scroll and the axis of the crankshaft influences the value of the resultant sealing force and the centrifugal or actuating force.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
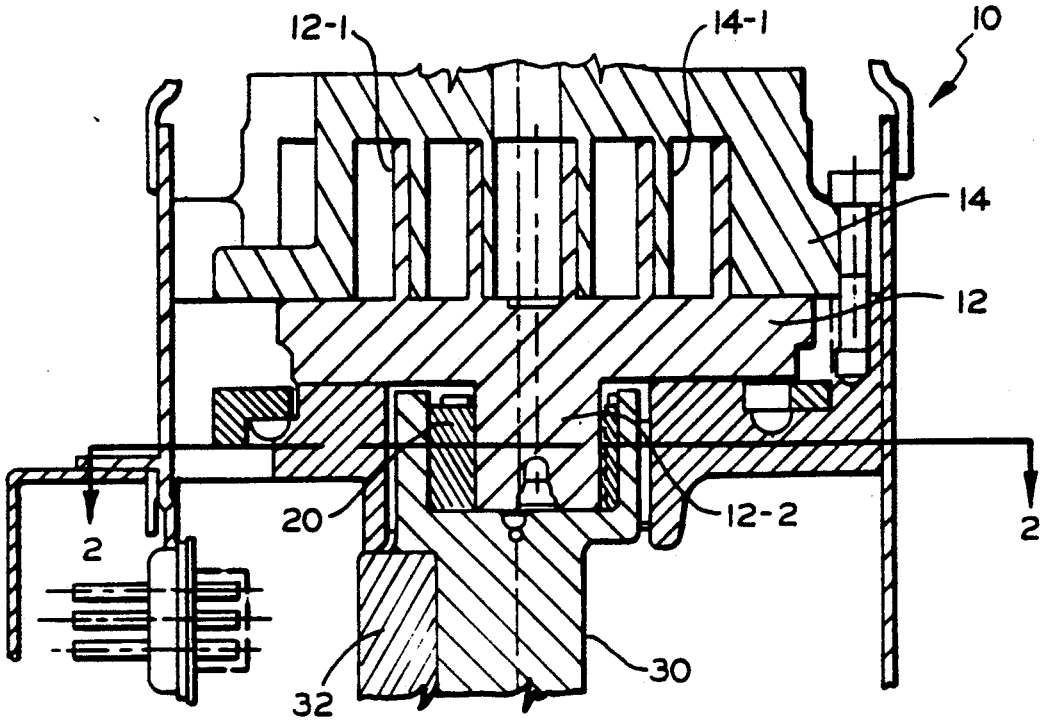
FIG. 1 is a vertical sectional view of a portion of a scroll compressor employing the slider block mechanism of the present invention.
Figure 2:
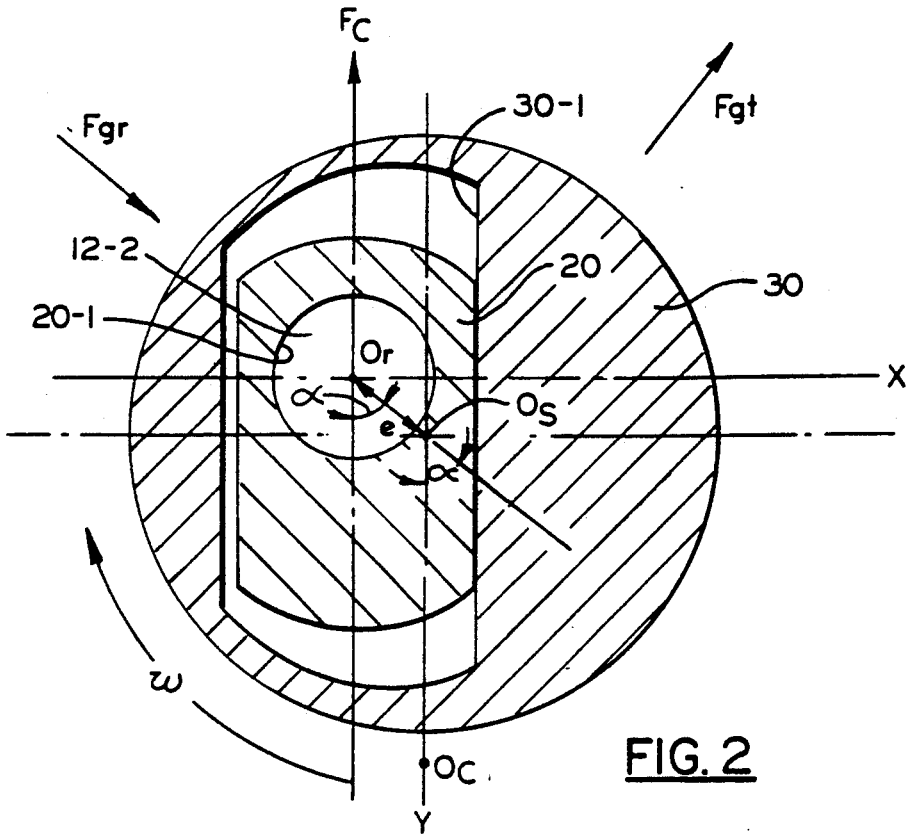
FIG. 2 is a sectional view of the slider block mechanism taken along line 2—2 of FIG. 1.

In FIG. 1, the numeral 10 generally indicates a scroll compressor which is only partially illustrated. Scroll compressor 10 includes an orbiting scroll 12 and a fixed scroll 14. Orbiting scroll 12 has a boss 12-2 which is received in bore 20-1 of slider block 20. As best shown in FIG. 2, slider block 20 is slidably received in recess 30-1 of crankshaft 30 but a reciprocating motion of slider block 20 in recess 30-1 is the only relative motion permitted between crankshaft 30 and slider block 20 other than generally insignificant movement permitted by the clearances between block 20 and recess 30-1. During operation, as crankshaft 30, counterweight 32 and slider block 20 rotate together about $O_s$ the axis of crankshaft 30, centrifugal force contributes to an actuating force which causes slider block 20 to move outwardly in recess 30-1 relative to $O_s$ carrying boss 12-2 and, therefore, orbiting scroll 12 with it.

Figure 3:
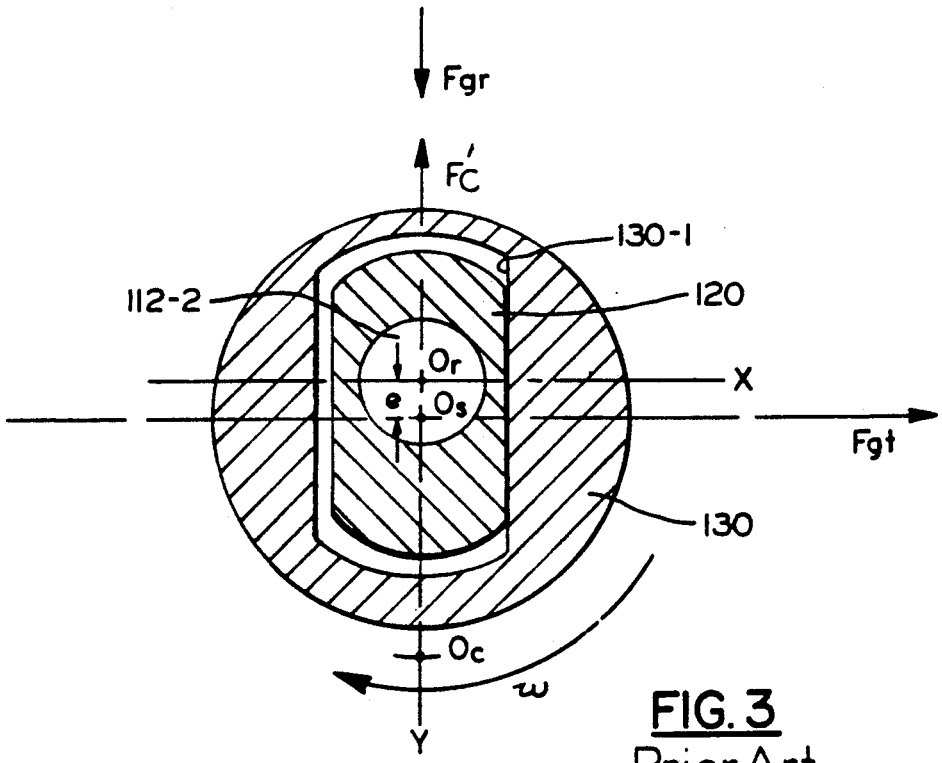
FIG. 3 Prior Art
FIG. 3 is a sectional view corresponding to that of FIG. 2 but with the activating and centrifugal forces acting along the same line as suggested by the PRIOR ART represented by U.S. Pat. No. 3,924,977.
Figure 4:
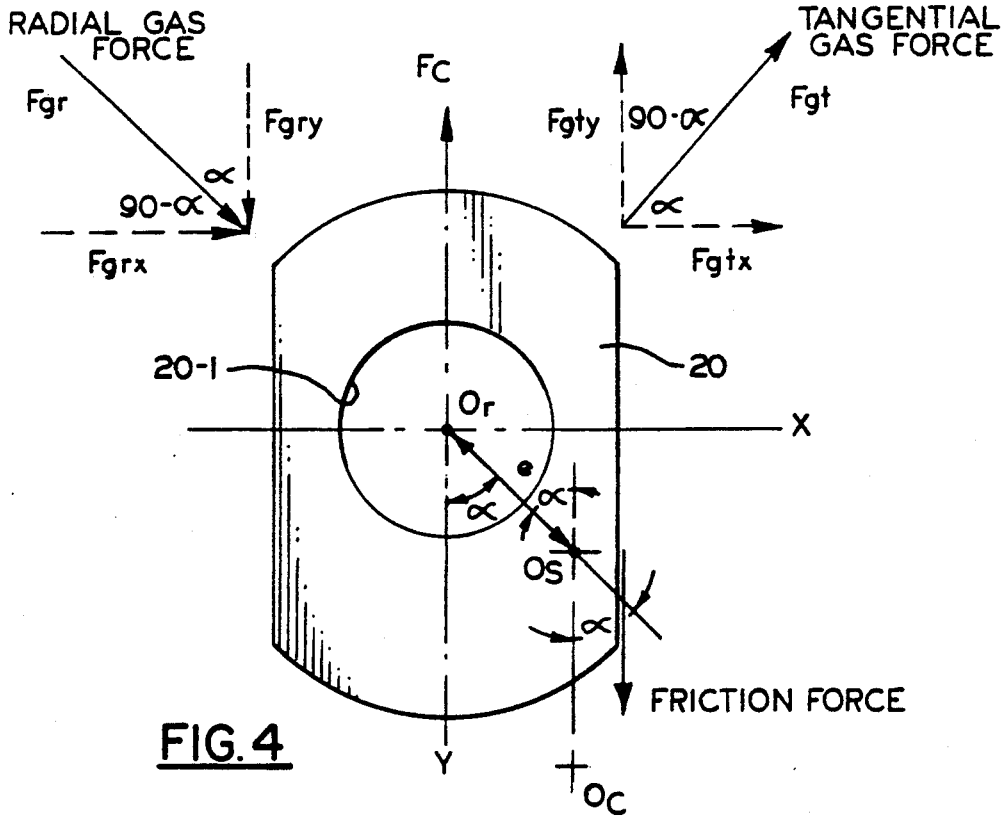
FIG. 4 is a force diagram corresponding to FIG. 2.

As noted above, a preliminary concept of slider block radial compliance is briefly mentioned in U.S. Pat. No. 3,924,977. This patent teaches the use of the centrifugal force, $F'_{c'}$ of the orbiting scroll to activate the radial sealing mechanism. This is illustrated in FIG. 3 which adapts the teachings of U.S. Pat. No. 3,924,977 to the slider block mechanism of the present invention. Structure is labeled one hundred higher than corresponding structure in FIGS. 1 and 2. The line of movement of the orbiting scroll is along the force, $F'_{c'}$ i.e. the line of movement which represents the actuating force is along the line from $O_c$, the counterweight center line/center of gravity, through $O_s$, the center of crankshaft 130 to $O_R$, the center of orbiting scroll. $F_c$ minus the radial gas force $F_{GR}$ is the sealing force, $F_{seal}$. Slider block 120 thus moves in recess 130-1 along the straight line defined by $O_c$, $O_s$ and $O_R$ carrying boss 112-2 of the orbiting scroll. Referring now to FIGS. 2 and 4, and comparing them to FIG. 3, it will be noted that the line of movement which represents the axis of relative movement between slider block 20 and crankshaft 30 as well as the location of $F'_c$ is displaced. Specifically, the y-axis always goes through $O_s$ and $O_c$ and, for the FIG. 3 device, also goes through $O_R$. Thus in the FIG. 3 device the centrifugal force, $F'_{c'}$ acts along the y-axis. In the FIG. 2 device, $O_R$ is located in and moves in a plane which is parallel to the plane defined by $O_s$, $O_c$ and the y-axis. The actuating force, $F'_{c'}$ is thus displaced with respect to the y-axis. The angle, $\alpha$ formed between the line joining the axis of the crankshaft, $O_s$, and the counterweight center line/center of gravity, $O_c$, and the extension of the line joining the center of the orbiting scroll, $O_R$, and $O_s$ represents the vector orientation of the radial gas force, $F_{gr}$, and the tangential gas force, $F_{gt}$, relative to the FIG. 3 orientation. In FIG. 3, the gas forces are along the x and y-axes, but, in FIGS. 2 and 4, the radial gas force acts along the line between $O_R$ and $O_s$ while the tangential gas force is perpendicular thereto. Thus, the tangential and radial gas forces each have components along both the x and y-axes.

In the FIG. 3 configuration, the centrifugal force, $F'_{c'}$ is directly opposed by the radial gas force, $F_{gR}$, since they both act along the y-axis. The tangential gas force $F_{gT}$ acts along the x-axis. The gas forces are produced by the gas in the trapped volumes between the wraps 14-1 and 12-1 of the fixed and orbiting scrolls 14 and 12, respectively, and oppose $F'_c$ with the net force being the sealing force, $F_{seal}$. In the configuration of FIGS. 2 and 4, there is an x and a y component of both $F_{gR}$ and $F_{gT}$. The y component of the radial gas force, $F_{gRy}$, is equal to $F_{gR} \cos \alpha$ while the y component of the tangential gas force, $F_{gTy}$, is equal to $F_{gT} \cos (90-\alpha)$. As a result, the opposition to $F'_c$ provided by $F_{gR}$ is reduced to $F_{gR} \cos\alpha$ while $F_{gT}$ now provides an assist to $F'_c$ equal to $F_{gT} \cos (90-\alpha)$. The resultant increase in the net effective sealing force is plotted in FIG. 5 which clearly shows the increase in $F_{seal}$ with the increase in the offset angle, $\alpha$. The point at 0° represents the FIG. 3 configuration for a sealing force of 100 pounds of force. The increase in the net sealing force is limited by how much the slider block 20 can be displaced within the crankshaft 30. If for example, $\alpha$ is limited to about 30° the value of the net sealing force will be tripled. If should be noted that $O_R$, and therefore the value of $\alpha$, as well as e, the distance between $O_R$ and $O_s$ and the orbiting radius of orbiting scroll 12, can change as slider block 20 moves in slot 30-1 due to wear or to a liquid slug trapped between the wraps 12-1 and 14-1. The net tangential gas force acting along the x-axis is equal to $F_{gTX}$ plus $F_{gRx}$ or $F_{gT} \cos \alpha$ plus $F_{gR} \cos (90-\alpha)$. Since the x-axis component $F_{gT}$ is reduced but the x-axis component of $F_{gR}$ is increased, the net tangential gas forces are less influenced by $\alpha$ than the net radial gas forces. Further, the net tangential gas forces do not have a significant effect on the operation of scroll compressor 10 relative to the net radial gas forces. Movement of slider block 20 is also opposed by a frictional force which is shown in FIG. 4 but has no significant influence on the operation of the present invention.

Figure 5:
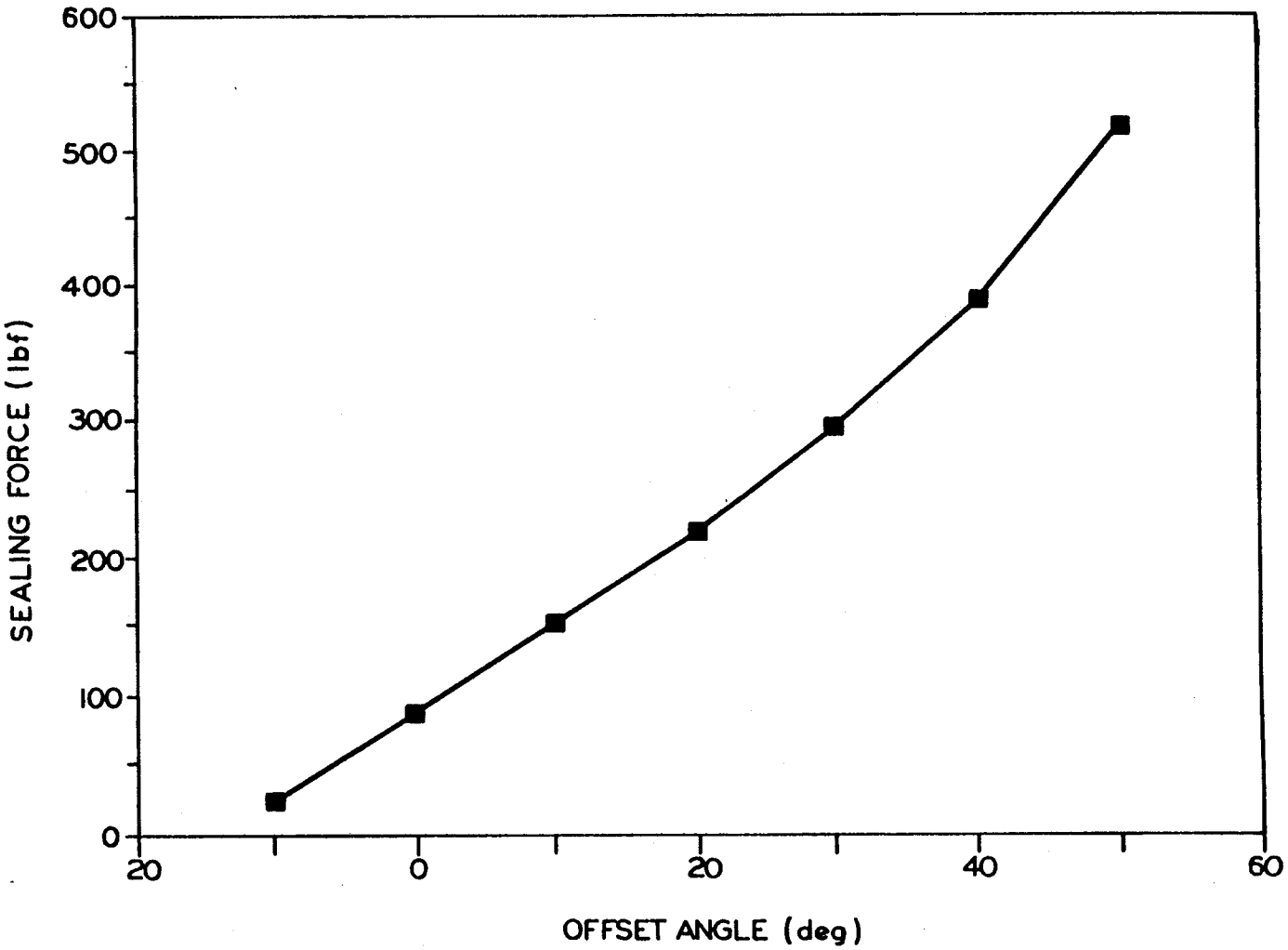
FIG. 5 is a graph of the sealing forces vs. the offset angle.

The present invention thus teaches the change in orientation from that of FIG. 3 to that of FIG. 2 such that a combination of centrifugal and gas forces are used to activate the slider block 20 and provide a sealing force between the scroll elements. By changing the orientation from that of FIG. 3 to that of FIG. 2, the magnitude of $F_{seal}$, the sealing force between the scroll elements, and of its component $F'_{c'}$ the activating force to move slider block 20, is increased as illustrated in FIG. 5.

From the foregoing, it should be clear than $F_{seal}$ which corresponds to the contact force between the wraps 12-1 and 14-1, is, ideally, a small positive number within the boundary of operation so as to maintain a direct contact between the wraps while reducing any friction and wear between them. Thus, as shown in FIG. 5 an increase in the offset angle $\alpha$ between the line joining $O_s$ and $O_c$ and the extension of the line joining $0_R$ and $O_s$ results in a substantial favorable increase in $F_{seal}$.

Although a preferred embodiment of the present invention has been illustrated and described, other changes will occur to those skilled in the art. For example, although orbiting scroll 12 is described and illustrated as having a boss 12-2 which is received in bore 20-1 of slider block 20, slider block 20 could be provided with a boss which is received in a recess in orbiting scroll 12. It is therefore intended that the scope of the present invention is to be limited only by the scope of the appended claims.

What is claimed is:

1. In a scroll compressor means having an orbiting scroll means having an axis, a fixed scroll means, crankshaft means having a first and a second end and adapted to rotate about an axis of said crankshaft means, counterweight means having a center of gravity spaced from said axis of said crankshaft means and rotatable with said crankshaft means, a slider block radial compliance mechanism comprising:

a recess means formed in said first end of said crankshaft means in the direction of said axis of said crankshaft means and elongated in a direction parallel to an asymmetrically located with respect to a plane defined by and axis of said crankshaft means and said center of gravity;

a slider block means located in said recess means and coacting therewith such that substantially only relative reciprocating movement of said slider block means in said elongated direction of said recess means is possible;

said slider block means and said orbiting scroll means coacting together such that relative rotary motion about said axis of said orbiting scroll means is possible between said slider block means and said orbiting scroll means and said orbiting scroll means is moved with said slider block means when said slider block means moves in relative reciprocating movement in said recess means;

said axis of said orbiting scroll means being spaced from said plane defined by said axis of said crankshaft means and said center of gravity.

2. The radial compliance mechanism of claim 1 wherein said relative reciprocating movement of said slider block means causes said axis of said orbiting scroll means to move in a plane spaced from and parallel to said plane defined by said axis of said crankshaft means and said center of gravity.

3. The radial compliance mechanism of claim 1 wherein a boss is formed on said orbiting scroll means and received in a bore formed in said slider block means.

4. A slider block radial compliance mechanism for a scroll compressor having an orbiting scroll with a wrap on one side and a boss on an opposite side and a fixed scroll comprising:

a crankshaft means including a counterweight having a center of gravity and said crankshaft means having a first and a second end and adapted to rotate about an axis of said crankshaft means which is spaced from said center of gravity;

a recess means formed in said first end in the direction of said axis of said crankshaft means such that said axis of said crankshaft means passes through said recess means and said recess means being elongated in a direction transverse to said axis of said crankshaft means;

a slider block means located in said recess means and coacting therewith such that substantially only relative reciprocating movement of said slider block means in said elongated direction of said recess means is possible;

said slider block means having a bore therein for receiving said boss such that said bore and said orbiting scroll are coaxial;

said axis of said crankshaft means and said center of gravity defining a first plane;

said bore having an axis which can move in a second plane spaced from and parallel to said first plane when said slider block means moves in said relative reciprocating movement in said recess means;

whereby centrifugal force is generated when said crankshaft means and slider block means are rotated together to thereby place said part of said orbiting scroll in sealing contact with said fixed scroll.

* * * * *